United States Patent [19]

Abramowitz et al.

[11] 4,040,286

[45] Aug. 9, 1977

[54] HIGH-PRECISION, FINE-DETAIL FORGING PROCESS

[75] Inventors: Philip Herbert Abramowitz, Beaver; Robert Wayne Balliett, Beaver Falls, both of Pa.

[73] Assignee: St. Joe Minerals Corporation, New York, N.Y.

[21] Appl. No.: 621,248

[22] Filed: Oct. 9, 1975

[51] Int. Cl.[2] ..... B21D 31/00

[52] U.S. Cl. ..... 72/377; 72/441; 72/453.01; 148/11.5 R

[58] Field of Search ..... 72/453, 441, 443, 364, 72/377; 148/11.5 R

[56] References Cited

U.S. PATENT DOCUMENTS

| | | | |
|---|---|---|---|
| 3,420,717 | 1/1969 | Fields | 148/11.5 R |
| 3,603,126 | 9/1971 | Newman | 72/453 |
| 3,734,785 | 5/1973 | Watson | 148/11.5 R |
| 3,753,791 | 8/1973 | Swanson | 148/11.5 R |
| 3,804,677 | 4/1974 | Swanson | 148/11.5 R |
| 3,843,416 | 10/1974 | Cross | 148/11.5 R |

OTHER PUBLICATIONS

"Superplasticity Pulls Ahead in Metal Forming", Iron Age, Nov. 18, 1971.

*Primary Examiner*—C.W. Lanham
*Assistant Examiner*—Gene P. Crosby
*Attorney, Agent, or Firm*—Harold L. Stowell

[57] ABSTRACT

High-precision, fine-detail forgings are formed from a workpiece material having superplastic forming characteristics by utilizing high strain rate forming to impart the bulk of the total deformation required and superplastic relatively low strain rate forming to impart detail and approach final tolerances in the product.

3 Claims, 2 Drawing Figures

HIGH-PRECISION, FINE-DETAIL FORGING PROCESS

BACKGROUND OF THE INVENTION

1. Field of the Invention

The invention is directed to a process for making high-precision, fine-detail forgings, utilizing a workpiece material with superplastic forming characeristics. The process involves high strain rate forming to impart the bulk of the total deformation required and superplastic forming to impact detail and approach final tolerances. The process is suitable for high production rates and minimizes or eliminates secondary machining.

2. Description of the Prior Art

Imparting detail and achieving precision in a forging is a difficult task regardless of the material. In commercial practice, it is common to use several dies to progressively impart detail in the forged component. In such progressive die forging processes, five or more intermediate steps each requiring special tooling may be employed, and still up to 80% of the original workpiece may have to be machined off to achieve final dimensions. Brass is an excellent forging material and many components are forged in a single step when brass is utilized. However, even with brass, high pressures developed in the forging operation limit detail that can be imparted, and again, extensive machining is usually required to achieve final dimensions, particularly for larger forgings, i.e., those weighing 1 pound or greater. Multitooling requirements as well as required processing contribute greatly to forging being considered a relatively expensive process. Many components which could benefit from the strength and toughness of a forging are cast or formed from powders for economical reasons.

Precision forging techniques have been developed which minimize secondary machining for aluminum and titanium, but these techniques are very slow and costly and thus far have been limited in use primarily to the aircraft and aerospace industries.

Work with eutectoid zinc-aluminum alloys has shown that superplasticity can be utilized to forge complex components close to final dimensions. However, superplasticity is a strain rate dependent phenomenon usually effective at relatively low strain rates. This condition leads to slow, expensive processing which has tended to limit commercial utilization.

Recent work with the eutectoid zinc-aluminum alloy demonstrates that this superplastic material behaves in a conventional manner when deformed at high strain rates. Thus, at strain rates typical of a mechanical press, the zinc alloy is not superplastic but displays a flow stress and ductility similar in magnitude to those of common aluminum forging alloys.

SUMMARY OF THE INVENTION

The present invention is a method for producing high-precision, fine-detail forgings at commercially acceptable production rates by combining the high strain rate forming of conventional forging techniques with the unique deformation behavior of superplasticity.

The process consists of forging a superplastic material in a conventional manner using conventional equipment to achieve a majority of the deformation required. The conventional forging is done preferably in a single step and the degree of deformation achieved is primarily limited by the capacity of the equipment and tooling. The conventional forming step is followed by a superplastic forging operation to impart detail and achieve or approximate design dimensions and tolerances. By the process of the invention, secondary machining can be minimized or eliminated. Overall production rates remain high since the slow superplastic forming process contributes only a small amount of the total deformation and thus is not time consuming.

High-precision, fine-detail forging can be performed in two separate operations utilizing different equipment and tooling, or in a single operation in which the velocity of the press is controlled to accommodate both high strain rate forming and superplastic deformation. An advantage of using separate setups is that process parameters, such as working temperature, lubrication system, and die design could be optimized for each type of deformation. However, this technique involves handling the workpiece between operations which may involve additional costs.

With many systems, e.g., a hydraulic drive, it is possible to advance the forging ram at a relatively high speed to accomplish the conventional forging step and, toward the end of the stroke, a hold at constant pressure can be used for the superplastic operation. With such a system, high precision and fine detail can be achieved in a single operation with one set of tooling, thus minimizing tooling and handling costs. Relatively high production rates will result for many forgings, since the superplastic operation requires no more than a second or two of deformation time.

The invention can be generally defined as a process for forming high-precision, fine-detail forging from a superplastic workpiece characterized by utilizing high strain rate forming to impart the bulk of the total deformation required and superplastic relatively low strain rate forming to impart detail and approach final tolerances in the product.

As used herein, high strain rate means those strain rates ranging from 10 sec $^{-1}$ to 200 sec $^{-1}$, and low strain rates are typically 1 sec $^{-1}$ and less.

While the invention is applicable to all materials which possess superplastic forming characteristics, particularly useful examples within the family of alloys based on the zinc-aluminum system are:

| Al | Cu | Zn | Traces |
|---|---|---|---|
| 5% | 0.1 to 5% | Bal. | Mg. and Ca. |
| 22% | 0 to 10% | Bal. | Mg. and Ca. |

Percentages are by weight

Percentages are by weight

Other materials known to have superplastic properties are:

| | |
|---|---|
| Cd-Zn eutectic | Mg-6% Zn-0.5% Zr |
| Sn-Pb eutectic | Mg-Al eutectic |
| Sn-2% Pb | Al-Cu eutectic |
| Sn-81% Pb | Cu-38% to 50% Zn |
| Sn | Cu-10% Al-3% Fe |
| Sn-Bi eutectic | Cu-71.9% Ag |
| Sn-1% Bi | Ni |
| Sn-5% Bi | Ni-39% Cr-10% Fe-1.75% Ti-1% Al |
| Zn (commercial) | Fe-C alloys |
| Zn-0.2% Al | Low alloy steels |
| Zn-0.4% Al | Cr-30% Co |
| Zn-$ZnO_2$ particles | Co-10% Al |
| Zn-W particles | Ti-5% A102.5% Sn |
| Zn-4.9% Al eutectic | Ti-4% Al-2.5% V |
| Zn-22% Al eutectoid | Ti-6% Al-4% V |
| Zn-40% Al | Ti-0.3% impurity |

-continued

| | |
|---|---|
| Mg (commercial) | Zircaloy (Zn-Sn 1.5%-Fe 0.12-Cr 0.10%) |
| Mg-0.5% Zr | W-15% to 30% Re |

BRIEF DESCRIPTION OF THE DRAWING

The invention will be more particularly described in reference to the drawing wherein.

DESCRIPTION OF THE PREFERRED EMBODIMENTS

Figure 1:
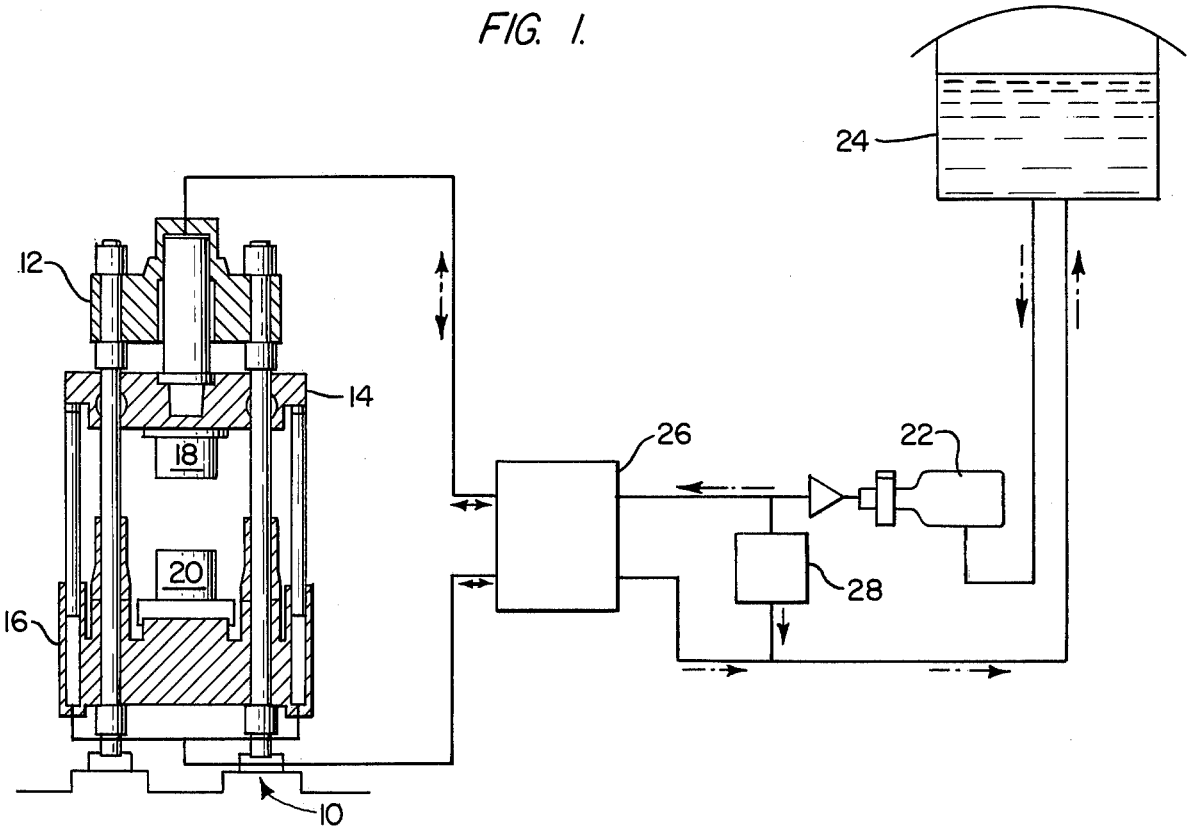
FIG. 1 is a diagrammatic view in partial section of a form of apparatus suitable for carrying out the present invention.

Referring to FIG. 1 of the drawing, there is diagrammatically illustrated apparatus suitable for carrying out the process of this invention. In FIG. 1, 10 generally designates a hydraulically operated single stage press with automatic pressure control having a stationary cylinder 12, a moving piston ram assembly 14, and a stationary press bed with return cylinders 16. The exposed faces of tool members 18 and 20 are adapted to receive the forging dies in known manner.

The press is driven by hydraulic pump 22 supplied with fluid from reservoir 24. The press cycle and speed is determined by control 26 and the limiting pressure is set by using the automatic pressure control circuit 28.

Figure 2:
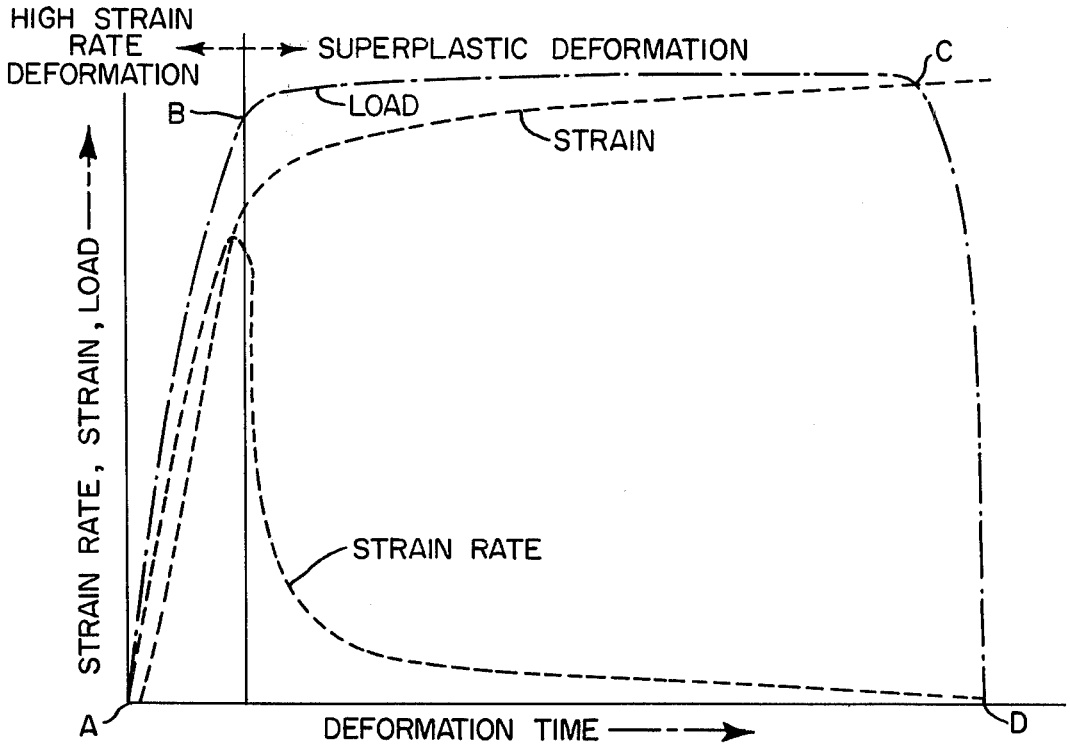
FIG. 2 shows the deformation cycle of the present invention in terms of strain rate, strain and load when using the apparatus presented in FIG. 1.

Referring to FIG. 2, point A designates the start of the forging cycle. At this point, tool member 18 in FIG. 1 is driven downward at a preset high velocity on the order of 10 in/sec to 200 in/sec by operating control 26 in FIG. 1. This operation produces most of the deformation as can be seen in FIG. 2 in going from Point A to point B. At point B, the maximum pressure is reached as preset using the constant pressure control 28 in FIG. 1. At this point, the strain rate will be controlled by the material at a value typically 1 sec $^{-1}$ and less and the superplastic deformation cycle will occur from point B to point C, completely forging the detail in the part. At point C, the press operation will be reversed using control 26 in FIG. 1 and the load will fall as shown from point C to point D in FIG. 2. The time interval from point B to point C will be set according to the requirements for the superplastic forming stage of a particular part. At point D in FIG. 2, the part will be removed from the die and the forging cycle will be complete.

The initial forging step may be accomplished at relatively high speed in a mechanical press with the low strain rate superplastic deformation being carried out in a separate hydraulic press.

EXAMPLES

Many varied types of difficult or impossible to forge parts can be produced using this technique. Features found in these parts will include little or no draft, sharp radii, forged threads, raised lettering, large rib to web ratios and flat, high tolerance surfaces.

A typical part produced by this process is a tank closure having a threaded lower end and a hexagonal tool receiving upper end. This part was formed from a zinc-aluminum alloy comprising aluminum 22%, copper 1%, traces of magnesium and calcium and the balance zinc. The forging was initially formed at a high strain of about 80 sec $^{-1}$ and the final detail in the cap and the threads were formed at a superplastic deformation rate of about 1 sec $^{-1}$.

Another part produced was a splined machine part having a thin web in one surface and a spline on the other surface having zero draft and sharp radii on the splined face. This part was forged from a zinc-aluminum alloy comprising aluminum 22%, copper 1%, traces of magnesium and calcium and the balance zinc. The forging was initially formed at a high strain ratte of about 60 Sec $^{-1}$ and the thin web and detail in the spline were produced at a superplastic deformation rate of about 1 Sec $^{-1}$.

We claim:

1. A process for forming high-precision, fine-detail forging from a superplastic workpiece characterized by utilizing high strain rate forming to impart the bulk of the total deformation required and superplastic relatively low strain rate forming to impart detail and approach final tolerances in the product.

2. The process defined in claim 1 wherein the high strain rate forming is at strain rates from about 10 sec $^{-1}$ to 200 sec $^{-1}$ and the low strain rate forming is at a strain rate of 1 sec $^{-1}$ and less.

3. The process defined in claim 2 wherein the superplastic workpiece comprises a zinc-aluminum alloy.

* * * * *